US007584710B2

(12) United States Patent
Grundy et al.

(10) Patent No.: US 7,584,710 B2
(45) Date of Patent: Sep. 8, 2009

(54) STORAGE DEVICE

(75) Inventors: Gary M. Grundy, South Milwaukee, WI (US); Jacqueline M. Dunstan, South Milwaukee, WI (US)

(73) Assignee: Armament Leather, Inc., South Milwaukee, WI (US)

( * ) Notice: Subject to any disclaimer, the term of this patent is extended or adjusted under 35 U.S.C. 154(b) by 524 days.

(21) Appl. No.: 11/234,338

(22) Filed: Sep. 23, 2005

(65) Prior Publication Data

US 2007/0068982 A1 Mar. 29, 2007

(51) Int. Cl.
*D05B 35/10* (2006.01)
*A45C 13/06* (2006.01)
*D05B 93/00* (2006.01)

(52) U.S. Cl. ..... 112/475.08; 112/153; 112/154; 112/441; 224/241; 224/676

(58) Field of Classification Search ..... 112/470.27, 112/140, 141, 152, 39, 46, 47, 50, 52, 62, 112/172, 173, 176, 178, 475.04, 475.08, 112/475.17, 260, 441, 154; 150/128, 130, 150/161, 33; 224/676, 622, 677, 678, 679, 224/681, 236, 911, 238, 239, 240, 142; 190/42, 190/18 A; D3/203.1–203.4, 201–212, 215, D3/225, 226, 228, 229, 230, 318, 321
See application file for complete search history.

(56) References Cited

U.S. PATENT DOCUMENTS

| | | | | | |
|---|---|---|---|---|---|
| 1,991,134 | A | * | 2/1935 | Brauer et al. | 112/2 |
| 2,388,739 | A | * | 11/1945 | Haas | 112/62 |
| 2,394,171 | A | * | 2/1946 | Haas | 112/62 |
| 2,652,014 | A | * | 9/1953 | Heggie | 112/49 |
| 5,002,214 | A | * | 3/1991 | Caranci | 224/669 |
| 5,351,868 | A | | 10/1994 | Beletsky et al. | |
| 5,632,426 | A | | 5/1997 | Beletsky et al. | |
| 7,258,259 | B1 | | 8/2007 | Owens | |

* cited by examiner

*Primary Examiner*—Ismael Izaguirre
(74) *Attorney, Agent, or Firm*—Foley & Lardner LLP

(57) ABSTRACT

A holder for use on a duty belt comprising a backing portion including a synthetic material coupled to a cover portion including a synthetic material is disclosed. An edging portion at least partially covers an edge of either the backing portion, the cover portion, or both. The backing portion and the cover portion are coupled by stitching, the stitching passing through the backing portion and the cover portion, and the backing portion and the cover portion are substantially flush along a seam at which the backing portion and the cover portion are joined.

10 Claims, 2 Drawing Sheets

STORAGE DEVICE

BACKGROUND

Security personnel, police officers, military personnel, and other personnel may carry a number of items on a duty belt. Such items may include a holster for a firearm, a magazine or speedloader pouch for holding extra ammunition for the firearm, and holders for other items such as mace or pepper spray, a baton, handcuffs, a flashlight, a knife, a radio, a cellular phone, or other items useful to such personnel.

Such holders have been made of leather. Leather has been a desirable material because of its durability and appearance. However, leather holders have several disadvantages. For instance, leather is a relatively heavy material, and it may absorb oils or grease causing stains. Even more problematic, leather can be easily contaminated with blood, which in turn is very difficult to remove from the holder. Blood contamination is particularly problematic for police officers who come in contact with injured victims of vehicle accidents and crimes.

To avoid such problems, holders have been made from a variety of synthetic material. One such material is trilaminate including an outer layer, a polyfoam layer, and a liner layer commercially available from Emtex Inc., of Danvers, Mass. These synthetic materials may be washable, durable, and/or lightweight. One type of holder made of such a trilaminate material is disclosed in U.S. Pat. No. 5,351,868 to Beletsky et al. Trilaminate materials of the type used in holsters have been described in U.S. Pat. Nos. 4,485,947 and 4,485,948 to Cook. However, some methods of making holders from synthetic materials require large investments in equipment, such as heat molding presses and molds, and labor costs. Some of the holders made according to these methods may include a welt about a perimeter of the holder where pieces of material are connected.

Accordingly, there is a need for a holder that may be worn on a duty belt, that can be manufactured without large equipment and labor costs. There is also a need for a holder that takes less space on a duty belt. There is still yet a need for a holder without a welt about its perimeter.

It would be advantageous to provide a holder or the like of a type disclosed in the present application that provides any one or more of these or other advantageous features. The present holder further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

SUMMARY

One embodiment relates to a holder comprising a backing portion and a cover portion coupled to the backing portion. An edging portion at least partially covers an edge of either the backing portion, the cover portion, or both. The backing portion and the cover portion are joined by stitching that passes through the backing portion, the cover portion, and at least a portion of the edging. The holder does not include a welt around a perimeter of the holder.

Another embodiment relates to a method of manufacturing a holder having a backing portion and a cover portion and a holder manufactured from the method. The method comprises aligning a side of one of the backing portion or the cover portion with an edge of the other of the backing portion or the cover portion and sewing through both the backing portion and the cover portion at an angle of about 30 to about 60 degrees relative to the backing portion.

Another embodiment relates to a synthetic holder for use on a duty belt, the holder comprising a backing portion including a synthetic material including a layer of ballistic nylon, a layer of poly foam, and a layer of liner material, and a cover portion including the synthetic material, coupled to the backing portion. A first edging portion at least partially covers an edge of the backing portion and a second edging portion at least partially covers an edge of the cover portion. The backing portion and the cover portion may be coupled by stitching, the stitching passing through the backing portion and the cover portion at about a 45 degree angle to the backing portions such that the holder does not include a welt around a portion of a perimeter of the holder.

DETAILED DESCRIPTION

Figure 1:
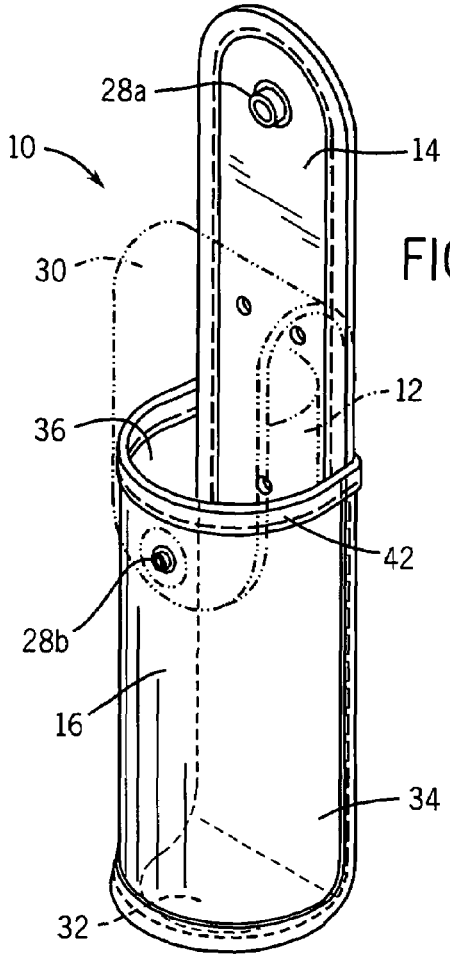
FIG. 1 is a perspective view of a holder.
Figure 2:
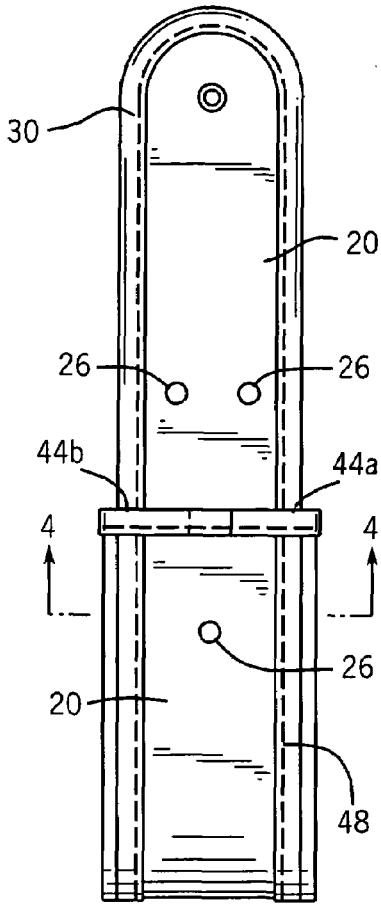
FIG. 2 is a back elevation view of the holder of FIG. 1.
Figure 3:
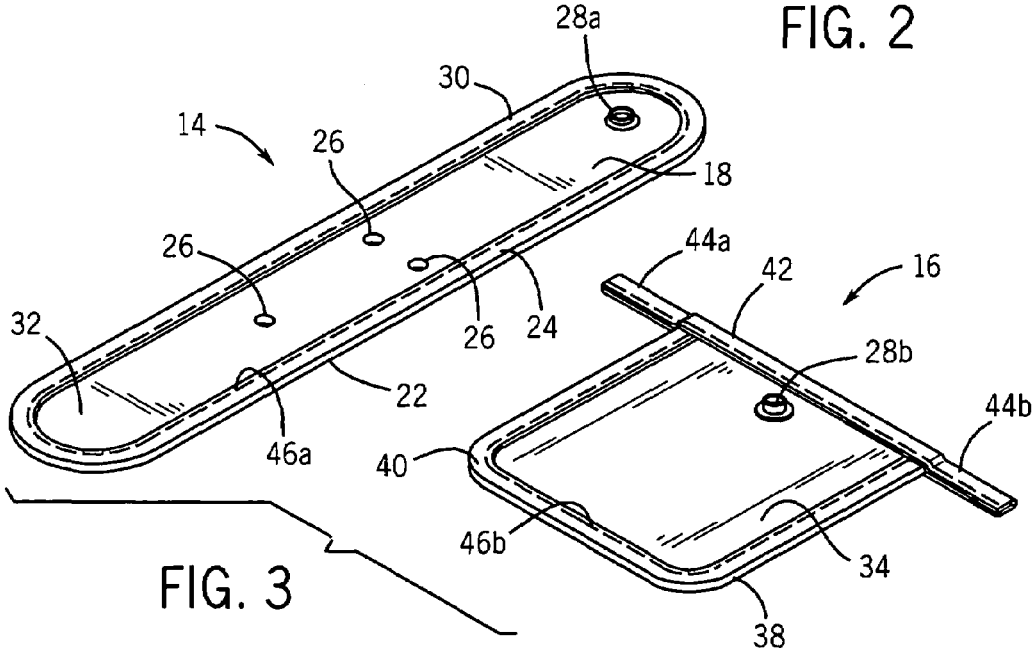
FIG. 3 is a perspective view of unassembled components of a holder.

Referring to FIGS. 1, 2, and 3, according to some embodiments, a storage device shown as a holder 10 designed for holding an item 12 includes a backing portion 14, and a cover portion 16. Backing portion 14 includes an inwardly facing surface 18, an outwardly facing surface 20, a perimeter defined by an edge surface 22, an edging 24, apertures 26, and fastener portion 28*a*. Backing portion 14 may include an upper flap portion 30 and a lower flap portion 32. Cover portion 16 includes an outwardly facing surface 34, an inwardly facing surface 36, a perimeter defined by an edge surface 38, an edging 40, an upper edging 42 including two apron portions 44*a* and 44*b*, and a fastener portion 28*b*.

Backing portion 14 and cover portion 16 may include edging 24 and edging 40, respectively, that extends at least partially about the perimeters of backing portion 14 and cover portion 16 to prevent fraying of the material used for backing portion 14 and cover portion 16. Edging 24 and 40 may be attached to backing portion 14 and cover portion 16 by stitching 46*a* and stitching 46*b*, respectively. Alternatively, edging may be attached by adhesive or other attachment method. According to some embodiments, edging 24 and/or edging 40 may comprise a nylon webbing. In some exemplary embodiments, edging 24 and/or edging 40 may be a #4000 ¾ inch nylon webbing of a type made in accordance with military specification Mil-W-4088K. One such nylon webbing is commercially available from Bally Ribbon Mills of Bally, Pa.

Backing portion 14 may also include one or more apertures 26. Apertures 26 may be used for riveting or otherwise attaching a belt loop, paddle, swivel, or other device for coupling holder 10 to a duty belt or otherwise allowing holder 10 be worn by a user or mounted to another object. Alternatively, backing portion 14 may lack apertures such that the belt loop or other device may be attached to backing portion 14 by stitching, adhesive, or other attachment method.

According to an exemplary embodiment, upper flap portion 30 of backing portion 14 also includes a fastener portion 28*a* that corresponds to fastener portion 28*b* of cover portion 16. Fastener portions 28*a* and 28*b* may be mating portions of a snap fastener. The snap fastener may comprise a "hard action" snap socket configuration. An individual in close proximity to a user wearing holder 10 is unlikely to know about the amount of force used to disengage the hard action fastener. Disengaging the "hard action" snap fastener is intended to be difficult and/or time-consuming for one who is not accustomed to the motion of the snap fastener and who is not wearing holder 10. According to various alternative embodiments, the snap fastener may be a "medium action," "easy action," "one directional security snap," and/or other suitable socket configuration. According to various alternative embodiments, any number of suitable fastening devices may be used for a fastener (e.g., Velcro® brand hook and loop fasteners, clips, etc.). Alternatively, holder 10 may not include an upper flap portion 30 such that holder 10 has an open top for receiving batons (such as expandable batons), or a flashlight.

In some exemplary embodiments, edge surface 22 of backing portion 14 may be aligned with inwardly facing surface 36 of cover portion 16 at roughly a 90 degree angle such that the outwardly facing surface 20 of backing portion 14 is substantially flush with edge surface 38 of cover portion 16 about a portion of the perimeters of both backing portion 14 and cover portion 16. Alternatively, edge surface 38 of cover portion 16 may be aligned with inwardly facing surface 18 of backing portion 14 such that edge surface 22 of backing portion 14 is substantially flush with outwardly facing surface 34 of cover portion 16. In some embodiments, where edge surface 22 of backing portion 14 is aligned with inwardly facing surface 36 of cover portion 16 at roughly a 90 degree angle such that the outwardly facing surface 20 of backing portion 14 is substantially flush with edge surface 38 of cover portion 16 about the perimeter of both backing portion 14 and cover portion 16, upper flap portion 30 of backing portion 14 may be wider than the rest of backing portion 14 to provide a neat look wherein the assembled holder 10 has a uniform width.

According to some embodiments, lower flap portion 32 of backing portion 14 forms a bottom of holder 10 such that item 12 is retained in holder 10 and does not fall out of the bottom. Alternatively, holder 10 may have an open bottom and/or an open top to accommodate items such as long-handled flashlights or batons.

According to an exemplary embodiment, holder 10 may be manufactured according to the following method. Backing portion 14 and cover portion 16 may be die cut from a bolt of synthetic material. Edging 24 may be stitched about the perimeter of backing portion 14. Edging 40 may be stitched about three sides of cover portion 16, and upper edging 42 may be attached to a fourth side of cover portion 16 providing apron portions 44*a* and 44*b*. Apertures 26 may be made in backing portion 14 to provide anchor points where a belt loop or other device may be riveted or otherwise coupled to holder 10. Fastener portions 28*a* and 28*b* may be attached to backing portion 14 and cover portion 16, respectively.

Edge surface 22 of backing portion 14 may be aligned with inwardly facing surface 36 of cover portion 16 at roughly a 90 degree angle such that the outwardly facing surface 20 of backing portion 14 is substantially flush with edge surface 38 of cover portion 16 about a portion of the perimeters of both backing portion 14 and cover portion 16. Alternatively, edge surface 38 of cover portion 16 may be aligned with inwardly facing surface 18 of backing portion 14 such that edge surface 22 of backing portion 14 is substantially flush with outwardly facing surface 34 of cover portion 16. Backing portion 14 and cover portion 16 may be temporarily secured to one another by glue, cement, or other suitable adhesive. Apron portions 44*a* and 44*b* of upper edging 42 may be folded over outwardly facing surface 20 of backing portion 14 and secured by adhesive, stitching, both adhesive and stitching, or other attachment method.

Figure 4:
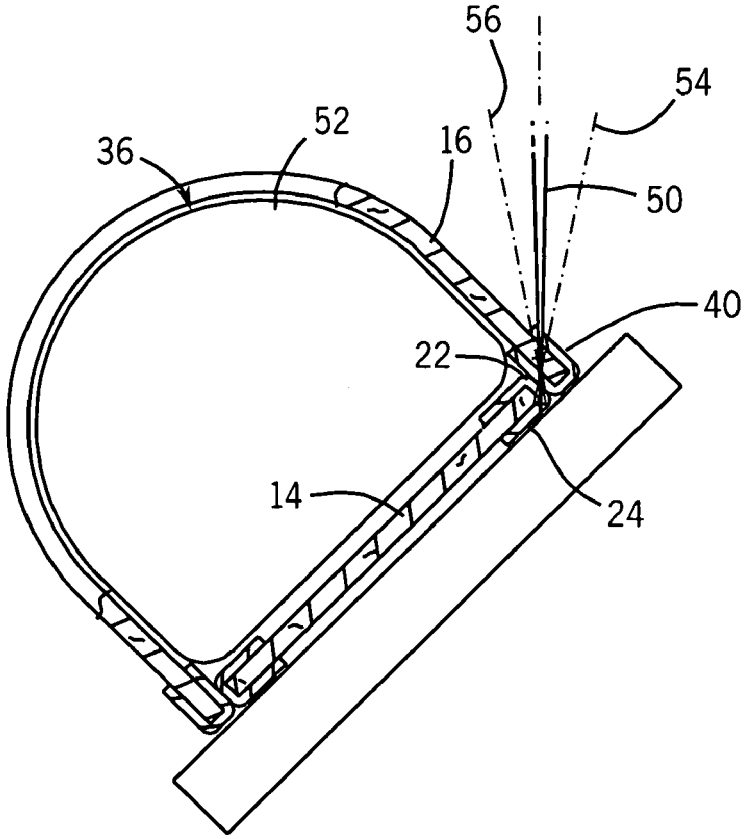
FIG. 4 is a cross sectional view of the holder of FIG. 2 taken along line 4-4.

Referring to FIG. 4, backing portion 14 may be more securely attached to cover portion 16 by stitching 48 (show in FIG. 2) that passes through both backing portion 14 and cover portion 16 at an angle of about 45 degrees from outwardly facing surface 20 of backing portion 14. Such a stitch may be referred to as a corner stitch configuration which creates a French edge. Alternatively, the stitching may pass through both backing portion 14 and cover portion 16 at an angle greater or lesser than 45 degrees depending on the thicknesses of backing portion 14 and/or cover portion 16. For example, stitching 48 may pass through holder 10 at any angle that allows stitching 48 to pass through both backing portion 14 and cover portion 16. In some such embodiments, such angles may be as steep as about 60 degrees or as shallow as about 30 degrees. In some embodiments, the angle at which stitching 48 passes through holder 10 may be even steeper or shallower so long as stitching 48 passes through backing portion 14 and cover portion 16. According to some embodiments, the corner stitch may be made using a Randall lockstitch machine using a modified block to orient holder 10 such that backing portion 14 is at about a 45 degree to needle 50. According to some exemplary embodiments, a block 52 may be inserted into holder 10 while stitching to maintain the desired shape of holder 10. According to some of these embodiments, block 52 has rounded or beveled edges to avoid contacting block 52 with the sewing needle during the stitching process. According to some embodiments, needle 50 may be at an angle other than 45 degrees. Two such angles are indicated by lines 54 and 56. According to some embodiments, backing portion 14 and cover portion 16 are coupled such that holder 10 does not include a welt about a perimeter of holder 10.

According to some embodiments, stitching 48 extends past apron portions 44*a* and 44*b* of upper edging 42. In some of these embodiments, a second stitching pass is made which passes through one or both of apron portions 44*a* and 44*b* of upper edging 42. This stitching provides for a strong connection between backing portion 14 and cover portion 16 at the point where apron portions 44*a* and 44*b* are folded over backing portion 14. This particular location is prone to stress when a user leans on the top of item 12 (such as a baton) when the user is standing at rest.

According to some embodiments, a strip of edging material may be placed such that stitching 48 secures the edging about an exterior of holder 10 to covering the seam between backing portion 14 and cover portion 16.

Figure 5:
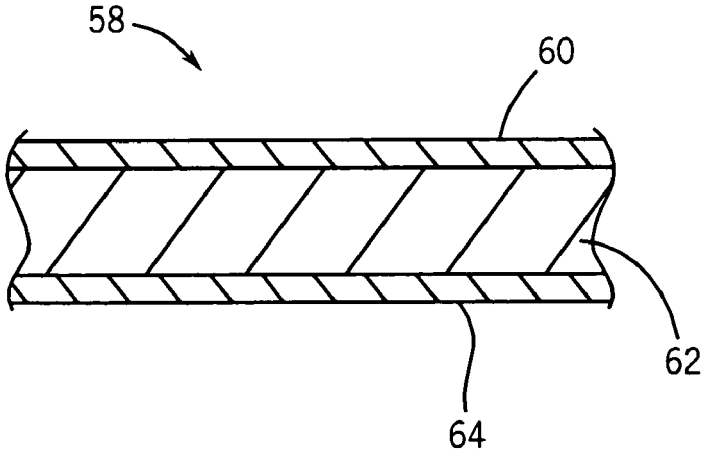
FIG. 5 is a schematic cross sectional view of a material segment.

Referring to FIG. 5, a material segment 58 that is suitable for use in fabricating holder 10 may include a trilaminate material having a first layer 60, a second layer 62, and a third layer 64. Material segment 58 may have any suitable thickness. In some embodiments, material segment 58 may have a thickness from about ⅛ to ¼ of an inch. In some of these embodiments, material segment 58 may have a thickness of about 3/16 of an inch. First layer 60 may generally be arranged to correspond to the outwardly facing surfaces of holder 10 (shown in FIG. 1). First layer 60 may generally be a synthetic material that is washable as well as tear and abrasion resistant. First layer 60 may be a woven synthetic material such as a woven ballistic nylon. One such material is 1050 ballistic nylon.

In other embodiments, first layer 60 may be another synthetic material that mimics the appearance of natural leather. Such synthetic materials may include a patterned surface such as a basket weave surface similar to PARAWEAVE® commercially available from Emtex Inc., of Danvers, Mass. Alternatively, first layer 60 may have a smooth surface, similar to VENTURE®, also commercially available from Emtex Inc., of Danvers, Mass. First layer 60 may have matte or gloss appearance.

According to some exemplary embodiments, second layer 62 may be a foam material. Suitable foam materials include closed cell polyethylene foam. Alternatively, other materials including cross-linked polyfoam, or other foam materials may be used.

According to some embodiments, third layer 64 may be a relatively soft liner material. Such materials include synthetics such as light woven nylons or nylon fleece, as well as other synthetics and natural materials. Third layer 64 may be oriented to correspond to the inwardly facing surfaces of holder 10. In some exemplary embodiments, third layer 64 is made from a material selected to reduce wear on exterior surfaces of item 12 that may come in contact with the inner surfaces of holder 10 when item 12 is stored or being placed in or removed from holder 10. The layers of material segment 58 may be combined to form a laminate by use of any of a variety of adhesives.

In some exemplary embodiments, material segment 58 may include a first layer 60 including 1050 ballistic nylon, laminated to a second layer 62 including a cross-linked polyfoam, laminated to third layer 64 including a knit liner layer.

Holder 10 is shown as a relatively long, narrow pouch which may be used for items such as expandable batons, folded knives, magazines, and other similarly shaped items. However, holders of other shapes may be fabricated, such as holsters for firearms or non-lethal devices such as a TASER® available from Taser International of Scottsdale, Ariz., handcuffs, silent key holders, batons, flashlights, chemical sprays, gloves, or almost any other holder for use on a duty belt. Alternatively, holder 10 may be adapted for use on a shoulder holster, ankle holster, tactical vest, or other base on which a user would place holder 10.

It is important to note that the above-described embodiments are illustrative only. Although the holders have been described in conjunction with specific embodiments thereof, those skilled in the art will appreciate that numerous modifications are possible without materially departing from the novel teachings and advantages of the subject matter described herein. For example, different types of devices (e.g., any suitable items to be stored in a holder) and assemblies may be used in addition to or instead of the those described herein. Accordingly, these and all other such modifications are intended to be included within the scope of the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangements of the preferred and other exemplary embodiments without departing from the scope of the appended claims.

What is claimed is:

1. A method of manufacturing a synthetic holder for use on a duty belt, the method comprising:

providing a backing portion made of a trilaminate material, the trilaminate material including a layer of nylon, a layer of polyfoam, and a layer of liner material;

providing a cover portion made from the trilaminate material;

aligning a side of one of the backing portion or the cover portion with an edge of the other of the backing portion or the cover portion; and sewing through both the backing portion and the cover portion to form the holder, wherein sewing through the backing portion and the cover portion includes providing a substantially flush junction between the edge and the side.

2. The method of claim 1, further comprising positioning a block to align the backing portion relative to the cover portion while sewing.

3. The method of claim 2, wherein the block has edges configured to avoid contacting a needle used for sewing through both the backing portion and the cover portion.

4. The method of claim 3, wherein the backing portion is coupled to the cover portion before sewing.

5. The method of claim 4, wherein the backing portion is coupled to the cover portion by an adhesive prior to sewing.

6. The method of claim 1, wherein at least one of the backing portion or the cover portion comprises a material including a layer of ballistic nylon.

7. The method of claim 1, wherein sewing includes sewing through both the backing portion and the cover portion at an angle of about 45 degrees relative to the backing portion.

8. A holder made according to the method of claim 1.

9. The holder of claim 8, wherein the backing portion and the cover portion include a material including a layer of ballistic nylon.

10. The method of claim 1, wherein sewing includes sewing through the backing portion at an angle between 30 and 60 degrees.

* * * * *